US010932061B2

(12) United States Patent
Wu et al.

(10) Patent No.: US 10,932,061 B2
(45) Date of Patent: Feb. 23, 2021

(54) SPEAKER

(71) Applicant: AAC Technologies Pte. Ltd., Singapore (SG)

(72) Inventors: Shuwen Wu, Shenzhen (CN); Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/699,147

(22) Filed: Nov. 29, 2019

(65) Prior Publication Data

US 2020/0204922 A1 Jun. 25, 2020

(30) Foreign Application Priority Data

Dec. 19, 2018 (CN) ..... 201822127520.5

(51) Int. Cl.

| | |
|---|---|
| ***H04R 9/02*** | (2006.01) |
| ***H04R 9/06*** | (2006.01) |
| ***H04R 15/00*** | (2006.01) |
| ***H04R 7/04*** | (2006.01) |
| ***H04R 1/28*** | (2006.01) |

(52) U.S. Cl.
CPC ..... *H04R 15/00* (2013.01); *H04R 1/2811* (2013.01); *H04R 7/04* (2013.01)

(58) Field of Classification Search
CPC ..... H04R 15/00; H04R 1/2811; H04R 7/04; H04R 2400/11; H04R 2201/029; H04R 9/02; H04R 9/06; H04R 1/02; H04R 1/021; H04R 2201/02; H04R 9/00
See application file for complete search history.

(56) References Cited

U.S. PATENT DOCUMENTS 2,458,158 A * 1/1949 Gilman ..... H04R 9/00 381/189

FOREIGN PATENT DOCUMENTS

JP 2001309488 A * 11/2001
KR 20030055819 A * 7/2003

OTHER PUBLICATIONS

English machine translation of JP-2001309488-A (Kato, Kazuma; Loudspeaker; published Nov. 2001) (Year: 2001).*
English machine translation of KR-20030055819-A (Cho, Seong Il; Combination Structure of Yoke and Frame for Speaker; published Jul. 2003) (Year: 2003).*

* cited by examiner

*Primary Examiner* — Mark Fischer
(74) *Attorney, Agent, or Firm* — W&G Law Group LLP

(57) ABSTRACT

The present invention provides a speaker, which includes a basket, a vibration system and a magnetic circuit system. The magnetic circuit system includes a magnetic frame, the magnetic frame and the basket define an accommodating space for accommodating the magnetic circuit system and the vibration system. The magnetic frame includes a magnetic frame bottom wall, a magnetic frame side wall extending from an outer side of the magnetic frame bottom wall towards the basket, and an extended portion extending from the magnetic frame side wall towards an outer side, the extended portion is provided with a plurality of protrusions formed by a semi-shearing process and protruding towards the basket, and an opening hole which is clamped and fixed with the protrusion is provided in a bottom wall of the basket. The speaker of the present disclosure has advantages of a stable structure size and suitability for accurate locating.

10 Claims, 4 Drawing Sheets

SPEAKER

TECHNICAL FIELD

The present disclosure relates to electroacoustic conversion technologies, and more particularly, to a speaker.

BACKGROUND

With a rapid development of electronic information technologies, more and more sound devices are applied to various electronic products, and especially applied to mobile communication devices widely used by people. Therefore, a demand for the sound devices also increases. In mass production, stability of a speaker structure and accuracy of locating closely affect a yield rate of the speaker during production.

In existing technologies, when a basket and a magnetic frame of the speaker are assembled, a protruding portion is usually formed by bending the magnetic frame, and the protruding portion is matched with and clamped in a corresponding opening in the basket to fix the magnetic frame. However, the protruding portion prepared by using the bending method has defects that a bending angle is not easy to control, and subsequent assembly processes are influenced.

Therefore, it is necessary to provide a new technical solution to solve the above-mentioned problem.

DETAILED DESCRIPTION

Figure 1:
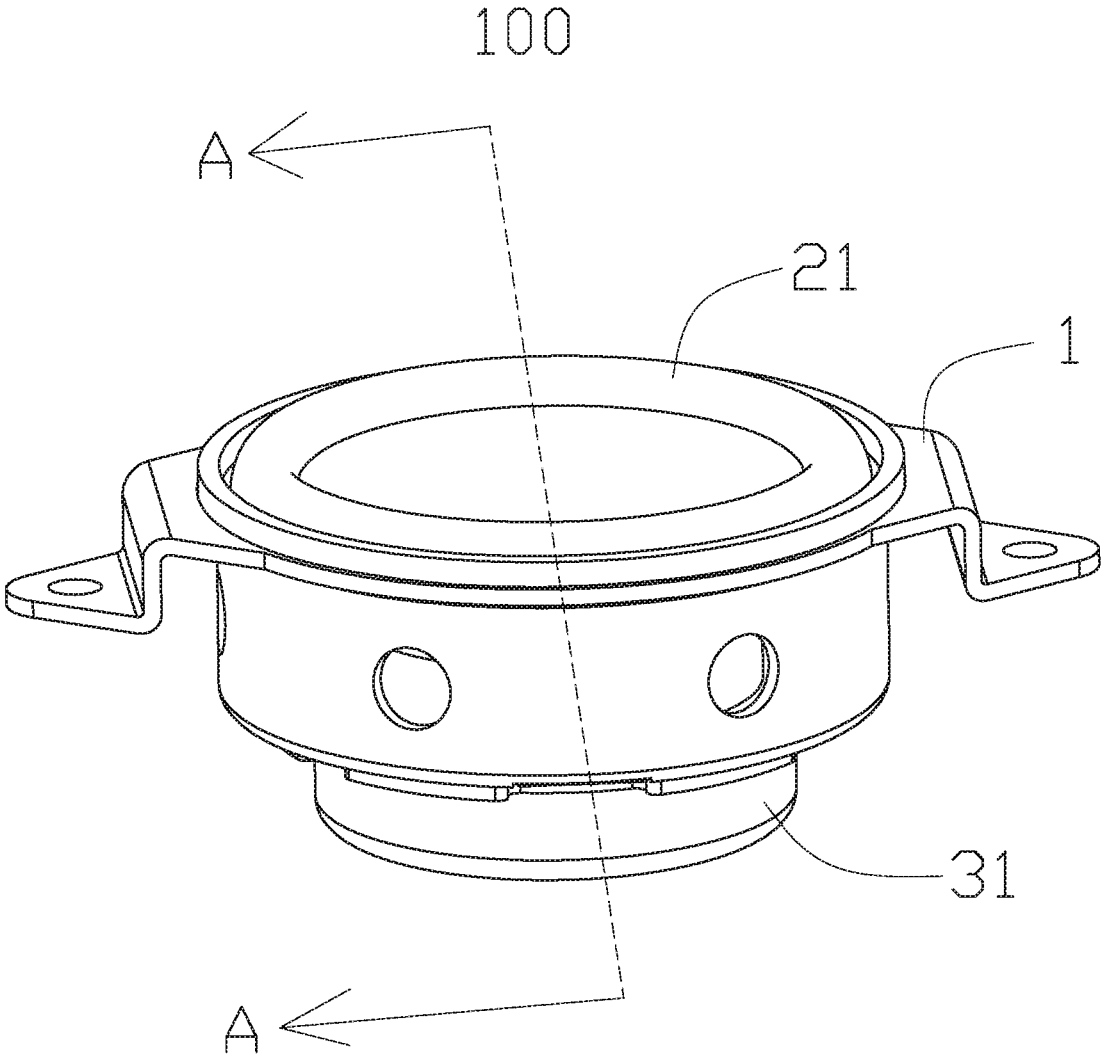
FIG. 1 is a perspective view of a speaker according to the present disclosure.
Figure 2:
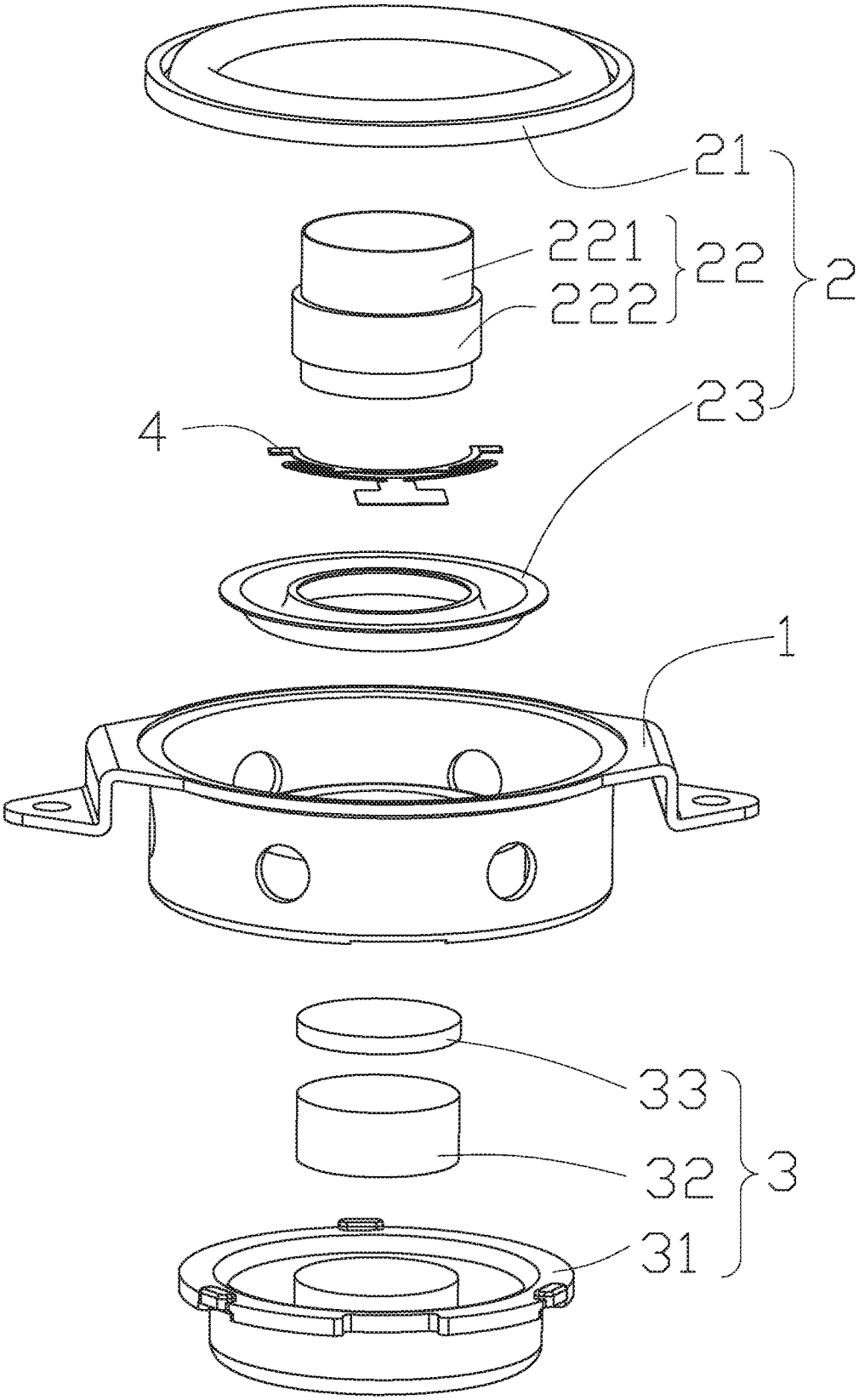
FIG. 2 is an exploded view of the speaker according to the present disclosure.

The present disclosure is further explained hereinafter with reference to FIGS. 1 to 6 and embodiments.

FIGS. 1 to 4 show a speaker 100 of the present disclosure, which includes a basket 1, a vibration system 2 and a magnetic circuit system 3. The magnetic circuit system includes a magnetic frame 31, and the basket 1 includes a basket bottom wall 11 clamped with the magnetic frame 31 and a basket side wall 12 extending from the basket bottom wall 11 towards a direction away from the magnetic frame 31. The basket side wall 12 includes a first side wall 121 extending from an outer side of the basket bottom wall 11 and a second side wall 122 extending from an inner side of the basket bottom wall 11. A cross section of the first side wall 121 and a cross section of the second side wall 122 vertical to a vibration direction are circular. In other alternative embodiments, the cross sections may be in other shapes. The basket further includes a basket upper wall 13 extending from one side of the second side wall 122 away from the magnetic frame 31 towards an inner side along a direction vertical to the vibration direction. The magnetic frame 31 and the basket 1 define an accommodating space 5 for accommodating the vibration system 2. The accommodating space 5 includes a first accommodating space 6 defined by the basket, and a second accommodating space 7 defined by the magnetic frame 31, the basket bottom wall 11, the basket upper wall 13 and the second side wall 122 together. The speaker 100 further includes a lower diaphragm 23 accommodated in the second accommodating space 7 and a flexible printed circuit board stacked on the lower diaphragm 23.

The vibration system 2 includes an upper diaphragm 21, a voice coil assembly 22 driving the upper diaphragm 21 to vibrate and sound, and a lower diaphragm 23 located at one side of the voice coil assembly 22 away from the upper diaphragm 21. The lower diaphragm 23 and the flexible printed circuit board 4 elastically support the voice coil assembly 22 together. The voice coil assembly 22 is electrically connected with the flexible printed circuit board 4. The voice coil assembly 22 includes a voice coil bobbin 221 and a coil 222 fixed on the voice coil bobbin 221.

The magnetic circuit system 3 includes the magnetic frame 31, a magnetic steel 32 stacked on the magnetic frame 31, and a pole core 33 attached to the magnetic steel 32. The magnetic frame 31 includes a magnetic frame bottom wall 311, a magnetic frame side wall 312 extending from an outer side of the magnetic frame bottom wall 311 towards the basket 1, and an extended portion 313 extending from the magnetic frame side wall 312 toward an outer side. The extended portion 313 is provided with a plurality of protrusions 314 formed by a semi-shearing process and protruding towards the basket 1.

The protrusion 314 is prepared by using a semi-shearing process, i.e., one side of the basket 1 is stamped with a punch, so that the basket is extruded into a recess in a mold to prepare and form the protrusion 314. The protrusion obtained by the semi-shearing process has advantages of a stable structure and a controllable size.

The protrusions 314 are evenly arranged on the extended portion 313 at intervals. In other alternative embodiments, the protrusions may also be unevenly separated from each other.

The protrusion 314 is arranged at an edge of one side of the extended portion 313 away from the magnetic frame side wall 312. At least a part of an orthogonal projection of the protrusion 314 on the extended portion 313 along a vibration direction of the speaker 100 is located outside the extended portion 313. In other alternative embodiments, the protrusion may also be arranged at other positions of the extended portion.

The magnetic frame 31 further includes a third side wall 315 extending from an inner side of the magnetic frame bottom wall 311 towards the basket 1 and a magnetic frame upper wall 316 extending from one side of the third side wall 315 close to the basket 1 towards a direction away from the magnetic frame side wall 312, The magnetic steel 32 is stacked on the magnetic frame upper wall 316. A cross section of the magnetic frame side wall 312 and a cross section of the third side wall 315 vertical to the vibration direction are circular. In other alternative embodiments, the cross sections may also have other shapes.

Figure 3:
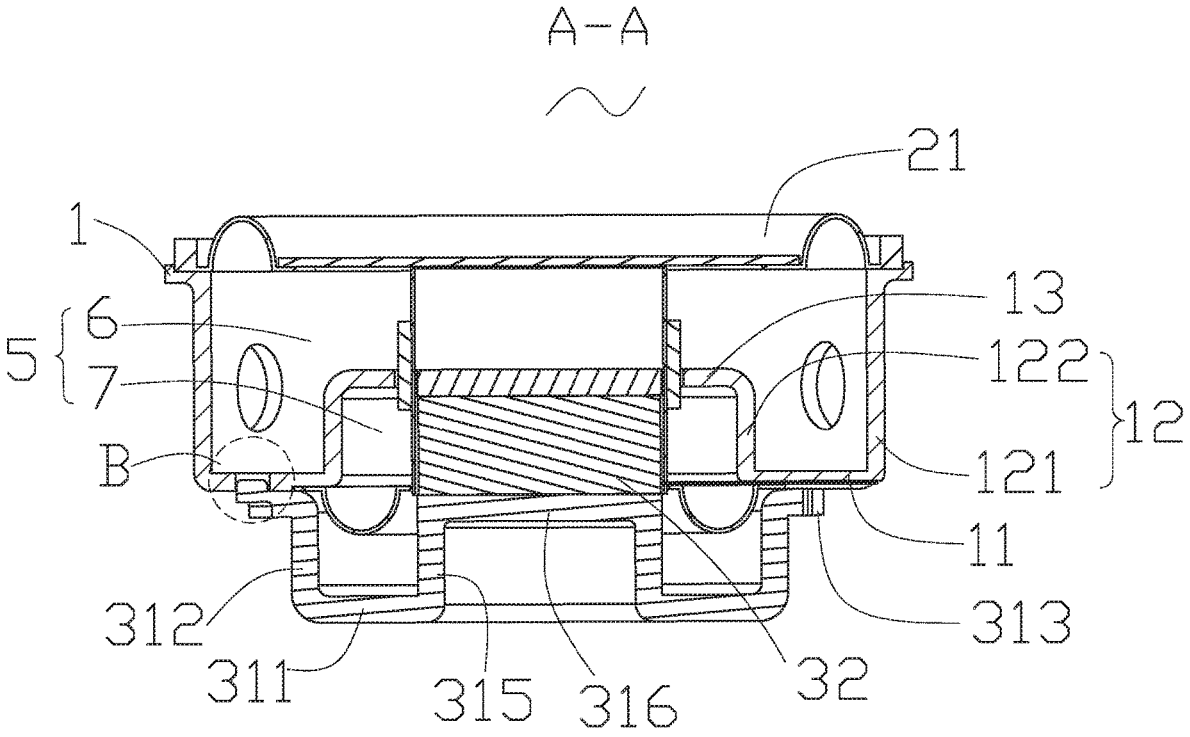
FIG. 3 is a sectional view of an A-A line along FIG. 1.
Figure 4:
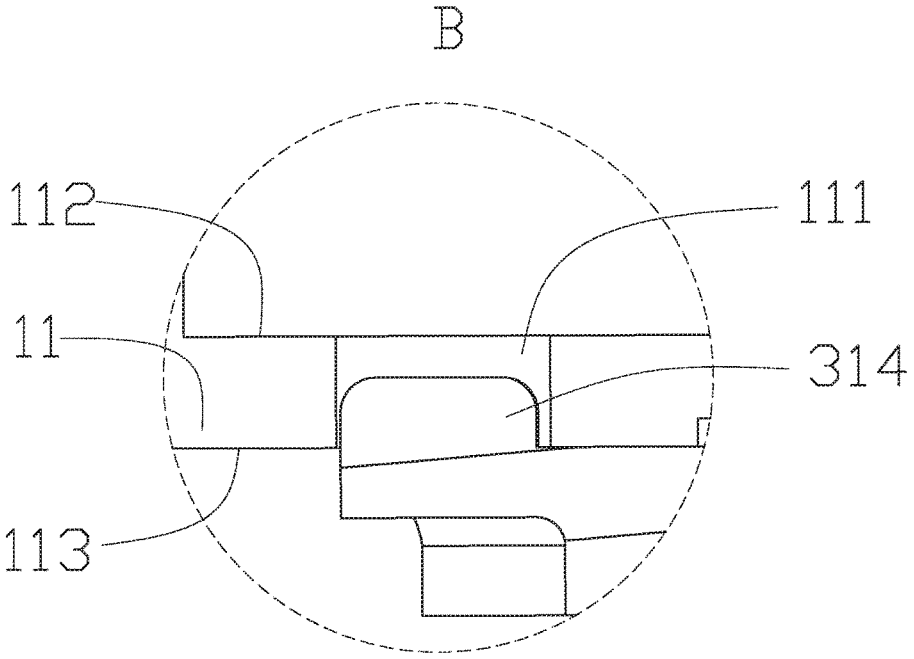
FIG. 4 is a partial enlarged view of a part B in FIG. 3.

As shown in FIG. 3 to FIG. 4, an opening hole 111 clamped and fixed with the protrusion 314 is provided in the basket bottom wall 11. The basket bottom wall 11 further includes a first surface 113 contacted with the extended portion 313 and a second surface 112 located in the accommodating space 5. The protrusion 314 is accommodated in the opening hole 111 and does not exceed the second surface 112. Since the protrusion 314 does not exceed the second surface 112, the protrusion 314 does not occupy a volume of the accommodating space 5, which facilitates designing an internal structure of the speaker 100.

Figure 5:
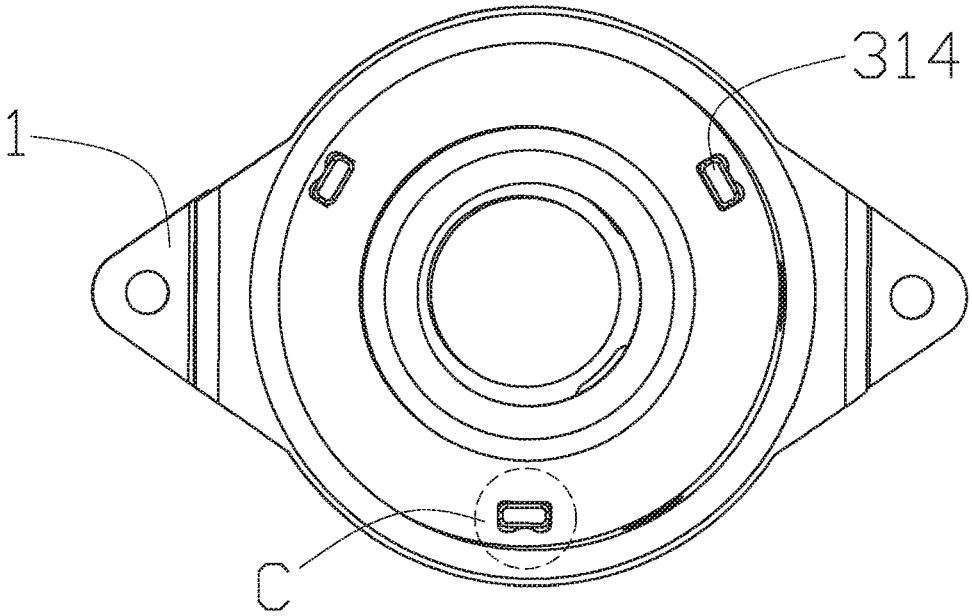
FIG. 5 is a top view of some components of the speaker according to the present disclosure.
Figure 6:
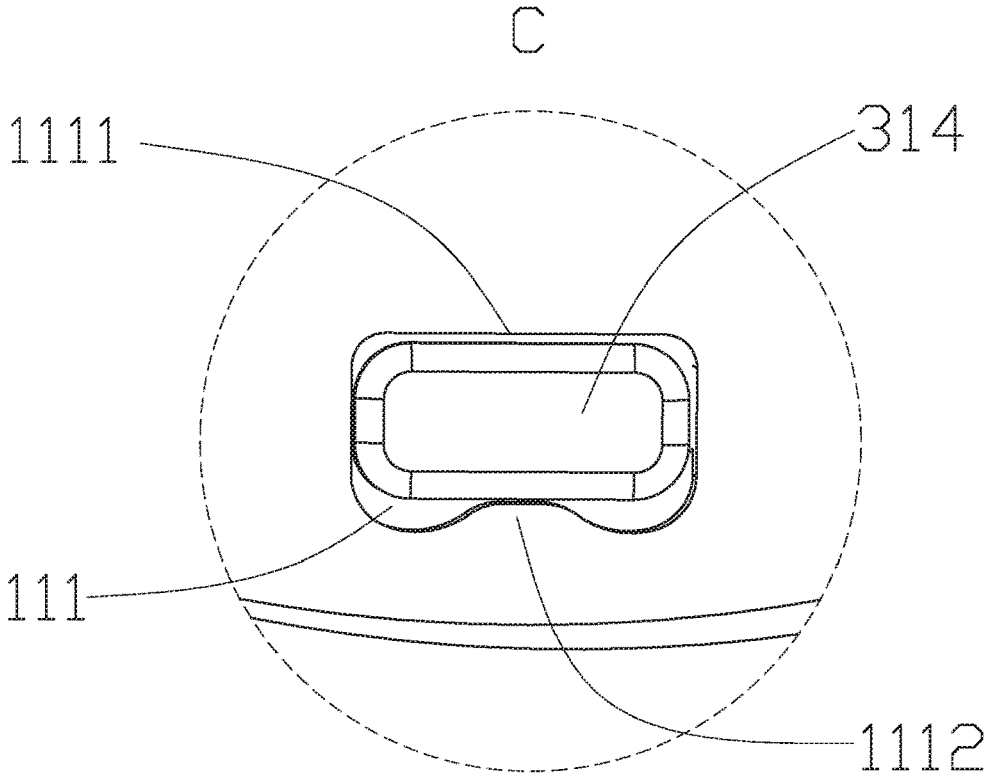
FIG. 6 is an enlarged view of a part C in FIG. 5.

As shown in FIG. 5 to FIG. 6, the basket further includes an inner wall surface 1111 defining the opening hole 111, at least one inner wall surface 1111 is provided with a matching portion 1112 protruding into the opening hole 111, and the matching portion 1112 abuts against the protrusion 314, Through an abutting matching between the matching portion 1112 and the protrusion 314, the magnetic frame 31 and the basket 1 can achieve a better matching effect, and structural stability of the speaker 100 is increased. In other alternative embodiments, the matching portion may not be provided.

The present disclosure has beneficial effects as follows: according to the speaker in the present disclosure, the protrusion with a stable structure is formed on the extended portion of the magnetic frame through a semi-shearing process, and is matched with the opening in the basket, thus forming a speaker with a stable structure and being suitable for precise assembly.

The description above is merely the embodiments of the present disclosure, and it should be pointed out that those of ordinary skills in the art may make improvements without departing from the concept of the present disclosure, and all these improvements shall belong to the scope of protection of the present disclosure.

What is claimed is:

1. A speaker, comprising: a basket, a vibration system and a magnetic circuit system, wherein the magnetic circuit system comprises a magnetic frame, the basket comprises a basket bottom wall clamped with the magnetic frame and a basket side wall extending from the basket bottom wall towards a direction away from the magnetic frame, the magnetic frame and the basket defining an accommodating space for accommodating the vibration system, the magnetic frame comprises a magnetic frame bottom wall, a magnetic frame side wall extending from an outer side of the magnetic frame bottom wall towards the basket, and an extended portion extending from the magnetic frame side wall towards an outer side, wherein the extended portion is provided with a plurality of protrusions formed by a semi-shearing process and protruding towards the basket, and an opening hole clamped and fixed with one of the protrusions is provided in a bottom wall of the basket.

2. The speaker according to claim 1, wherein the basket bottom wall comprises a first surface attached to the extended portion and a second surface located in the accommodating space, and the one of the protrusions is accommodated in the opening hole and does not exceed the second surface.

3. The speaker according to claim 1, wherein the basket further comprises inner wall surfaces defining the opening hole, at least one of the inner wall surfaces is provided with a matching portion protruding into the opening hole, and the matching portion abuts against the one of the protrusions.

4. The speaker according to claim 1, wherein the protrusions are evenly arranged on the extended portion at intervals.

5. The speaker according to claim 1, wherein the one of the protrusions is arranged at an edge of one side of the extended portion away from the vibration system.

6. The speaker according to claim 5, wherein at least a part of an orthogonal projection of the one of the protrusions on the extended portion along a vibration direction of the speaker is located outside the extended portion.

7. The speaker according to claim 1, wherein the basket side wall comprises a first side wall extending from an outer side of the basket bottom wall and a second side wall extending from an inner side of the basket bottom wall, the basket further comprises a basket upper wall extending from one side of the second side wall away from the magnetic frame towards the vibration system along a direction vertical to the vibration direction, and the accommodating space comprises a first accommodating space defined by the basket, and a second accommodating space defined by the magnetic frame, the basket bottom wall, the basket upper wall and the second side wall together.

8. The speaker according to claim 7, wherein the magnetic frame further comprises a third side wall extending from an inner side of the magnetic frame bottom wall towards the basket and a magnetic frame upper wall extending from one side of the third side wall close to the basket towards a direction away from the magnetic frame side wall, and the speaker comprises a magnetic steel stacked on the magnetic frame upper wall.

9. The speaker according to claim 7, wherein the speaker further comprises a lower diaphragm accommodated in the second accommodating space and a flexible printed circuit board stacked on the lower diaphragm.

10. The speaker according to claim 8, wherein a cross section of the first side wall, a cross section of the second side wall, a cross section of the magnetic frame side wall and a cross section of the third side wall vertical to the vibration direction are all circular.

* * * * *